US008800470B1

(12) United States Patent
Cummings

(10) Patent No.: US 8,800,470 B1
(45) Date of Patent: Aug. 12, 2014

(54) DIVE DOOR FOR RIGID INFLATABLE BOATS

(75) Inventor: Mason Cummings, New Smyrna, FL (US)

(73) Assignee: Brunswick Commercial and Government Products, Inc., Edgewater, FL (US)

( * ) Notice: Subject to any disclaimer, the term of this patent is extended or adjusted under 35 U.S.C. 154(b) by 161 days.

(21) Appl. No.: 13/408,467

(22) Filed: Feb. 29, 2012

(51) Int. Cl.
*B63B 17/00* (2006.01)

(52) U.S. Cl.
USPC ..... 114/362

(58) Field of Classification Search
USPC ..... 114/362
See application file for complete search history.

(56) References Cited

U.S. PATENT DOCUMENTS 5,832,864 A * 11/1998 Hemphill ..... 114/345
5,915,328 A * 6/1999 Rowan ..... 114/362
6,182,598 B1 * 2/2001 Bozzo ..... 114/362
7,004,101 B1 * 2/2006 Mardikian ..... 114/362
7,421,970 B2 * 9/2008 Levesque ..... 114/362
7,438,014 B2 * 10/2008 Kim ..... 114/345

* cited by examiner

*Primary Examiner* — Lars A Olson
*Assistant Examiner* — Jovon Hayes
(74) *Attorney, Agent, or Firm* — Malin Haley DiMaggio & Bowen, P.A.

(57) ABSTRACT

A dive door for an inflatable boat configured as a semi-cylindrical body having a planar platform surface and an outer curved surface. The door is hingeably attached to the deck of the boat and is disposed between a first gunwale tubing section and a second gunwale tubing section of the boat. The dive door is selectively operable between a deployed position and a closed position. In the deployed position, the planar platform surface extends outwardly from the boat and the outer curved surface faces downward toward the water. A hydraulic ram may be attached to and disposed between the platform surface and a rigid structure of the boat, whereby the hydraulic ram is translates the door between the deployed position and the closed position. In the closed position, the outer curved surface is coincident with the gunwale tubing such that it appears that the door is integrated into the boat.

8 Claims, 5 Drawing Sheets

DIVE DOOR FOR RIGID INFLATABLE BOATS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine vessels and components related thereto and more specifically to a dive and/or access door for a rigid inflatable boat.

2. Description of Related Art

Rigid-hulled inflatable boats, also known as rigid inflatable boats (RIB) are popular sea-faring vessels that are stable, seaworthy, and versatile. RIBs are useful in recreational, commercial, and military applications. A typical RIB comprises a solid, traditionally v-shaped hull having flexible inflatable tubes disposed around the gunwale (i.e. top edge of the side) thereof. RIBs are designed to be hydroplaning boats and can be powered by an outboard motor or an inboard water-jet motor. The hull of the RIB may be comprised of wood, steel, aluminum, fiberglass, glass-reinforced plastic, or combinations thereof. The inflatable gunwale tubing is often comprised of a resilient rubber or plastic composite such as, for example, hypalon, polyvinyl chloride or polyurethane. Many RIBs can outperform traditional fiberglass boats and often are more difficult to sink and provide improved ride and handling in heavy seas. Additionally, the relatively flexible and durable gunwale tubing provides protection for the RIB and other vessels and structures it may come in contact with.

As noted, RIBS are quite versatile and can be used as rescue craft, patrol vessels, dive boats, or tenders for larger boats. With respect to rescue and dive use, access between the vessel and the water is typically provided over the gunwale tubing or via a dive ladder extending off the tubing or transom. Although boarding/de-boarding over the gunwale is not difficult for an able-bodied individual, it is not ideal when dealing with an injured individual who may be strapped to a stretcher or other rescue device. Over-the-gunwale boarding/de-boarding is likewise not ideal for a rescuer/diver that may be carrying several pounds of cumbersome equipment. Similarly, boarding/de-boarding by way of a dive ladder only allows for one individual to board at a time and is typically not effective for loading and unloading stretchers and other equipment.

Because of the shortcomings associated with over-the-gunwale and/or ladder access in RIB applications, several attempts at providing a dive/access door have been made. For example U.S. Pat. No. 7,438,014 to Kim, discloses a quick release, selective open area for a rigid inflatable boat for the purpose of providing emergency/life saving access. The system includes a fixed arc-shaped primary tube and a rear tube slideably installed adjacent to one end of the primary tube. The rear tube is slideable forward and backward along a sliding rail which is supported by a guiding member. A holding means is provided for securing the front end of the rear tube to the rear of the arc-shaped primary tube. When slide rearward, the open space between the rear tube the primary tube provides boarding access to the vessel.

U.S. Pat. No. 7,421,970 to Levesque discloses an access device for RIB's which includes a securable flap assembly along with a removable section of the tube. The flap assembly is secured on either side to two permanent sections of the RIB's gunwale tubing and provides straps or other closure means to keep the flap secured to the side of the boat when closed. When opened, the straps are released and the flap extends into the water. The removable section of the tube is removed, exposing an access/boarding area in the gunwale tubing of the boat.

U.S. Pat. No. 7,004,101 to Mardikian relates to a conventional fiberglass-hulled vessel having a side section which can act as a loading platform. The platform/door is incorporated into the side of the hull and pivots on hinges from a vertical to horizontal position. The door in controlled by pulley and cable assembly which allows the user to operatively selected between open and closed positions.

U.S. Pat. No. 5,915,328 to Rowan relates to a boat hull which incorporates a buoyant panel section that is supported by a hinge assembly along the side of the hull. A plurality of pivotal links control movement of the panel and, in a down position, the panel provides a boyant loading platform.

U.S. Pat. No. 5,832,864 to Hemphill describes to a diver's door for an inflatable boat comprising a removable section of the gunwale tubing. The removable section is secured to opposing sides of the gunwale tubing by flanges that are secured around end caps of the gunwale tubing. The removable section is inflated to form a tight fit and deflated for removal.

Although the prior art provides some useful dive/boarding doors, none provide a rigid inflatable boat with an access door that provides a substantially flat working platform that extends outboard of the hull. Indeed, with respect to inflatable boats, the prior art only describes devices or methodology for providing a gap or opening the gunwale tubing, without any platforms or working areas. Furthermore, the dive/boarding doors described the prior art are not easily opened and closed without the need for complicated hinges, latches, straps, or other closure means. Consequently, there is a need in the art for a easy-to-operate dive/boarding access door for RIBS that provides a large working platform ideal for rescue and diving operations.

It is, therefore, to the effective resolution of the aforementioned problems and shortcomings of the prior art that the present invention is directed. However, in view of the dive/boarding doors in existence at the time of the present invention, it was not obvious to those persons of ordinary skill in the pertinent art as to how the identified needs could be fulfilled in an advantageous manner.

SUMMARY OF THE INVENTION

The present invention provides a dive/access door for an inflatable boat that is operatively positionable between at least an open and closed position. In some embodiments, the dive door is provided for a boat having a rigid hull, a deck, a first gunwale tubing section, and a second gunwale tubing section wherein the first and second gunwale tubing sections are disposed around the top portion/perimeter of the hull, i.e. the gunwale. The dive door comprises a semi-cylindrical body having a planar platform surface and an outer curved surface. A foam insert may be disposed between the platform surface and the outer curved surface in order to provide buoyancy and shock absorption. In some embodiments, the door is hingeably attached to a portion of the deck of the boat; and the door disposed between the first gunwale tubing section and the second gunwale tubing section of the boat. In some cases, the dive door is located on one side of the boat such that the first gunwale tubing section delimites an arc around the vessel and the second gunwale tubing section is a relatively smaller section toward the transom of the side of the boat where the door is located.

The dive door is selectively operable between a deployed position and a closed position, wherein in the deployed position, the planar platform surface extends outwardly from the boat and the outer curved surface faces downward toward the water. A hydraulic ram may be attached to and disposed between the platform surface and a rigid structure of the boat, such as a rear console, wherein the hydraulic ram is configured to translate the door between at least the deployed position and the closed position. The ram may be electronically actuated by a control on the boat. In some embodiments, in the closed position the outer curved surface is coincident with the first and second gunwale tubing sections such that it appears that the door is integral with the gunwale tubing of the inflatable boat.

Accordingly, it is an object of the present invention to provide a dive/access door for an inflatable boat that, when deployed, provides a platform surface that extends outwardly from the boat in order to provide increase working surface area.

It is another object of the present invention to provide a dive/access door for an inflatable boat that can be electronically actuated by a user on the boat, without the need to manually remove, slide, or alter any of the structural components of the boat.

It is yet another object of the present invention to provide a dive/access door for an inflatable boat that appears integrated with the gunwale tubing thereof when closed, but provides a large, stable, and sturdy working surface when deployed.

In accordance with these and other objects which will become apparent hereinafter, the instant invention will now be described with particular reference to the accompanying drawings.

DETAILED DESCRIPTION

Figure 1:
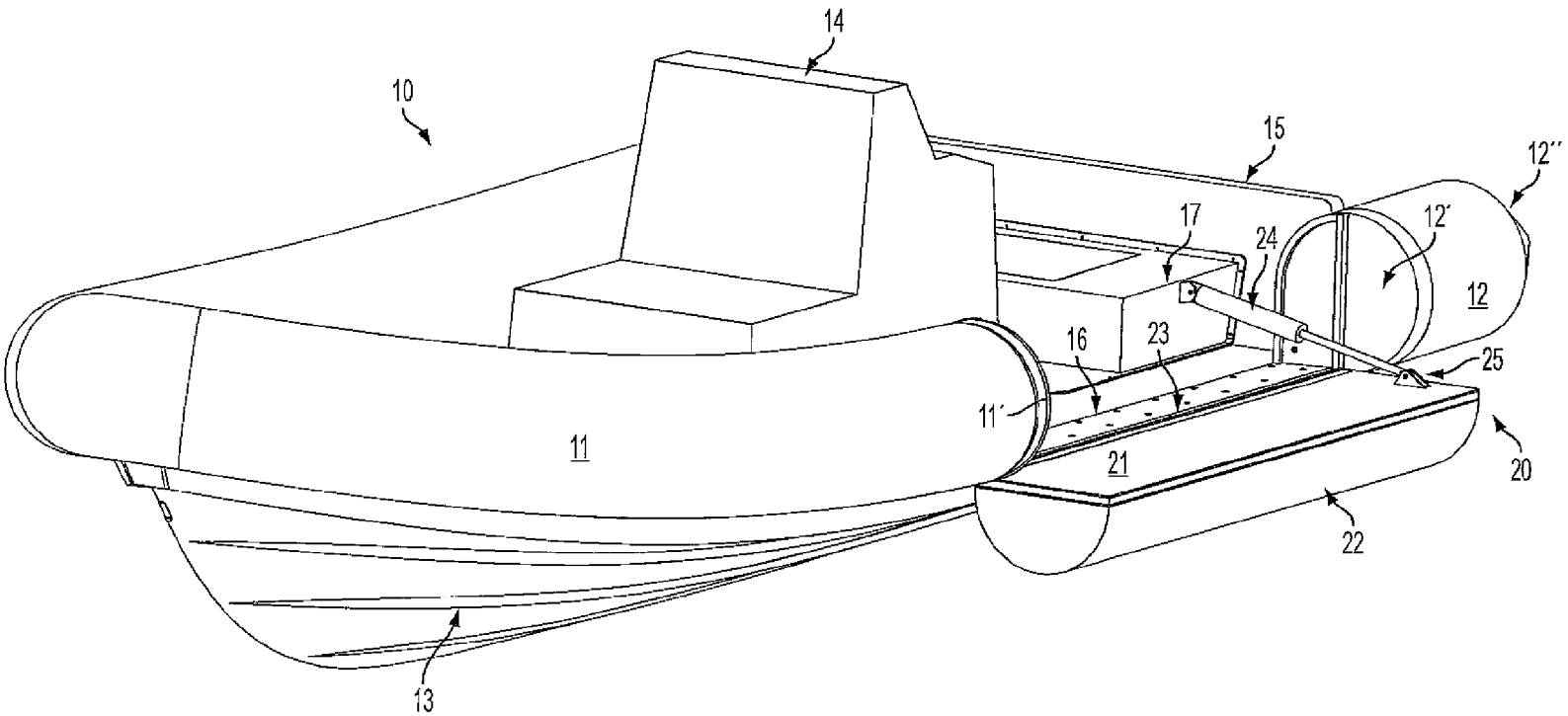
FIG. 1 is a perspective view of a boat including one embodiment of the present invention.

With reference to FIG. 1, shown is a boat 10 configured generally as a rigid inflatable boat. As shown, boat 10 includes a first gunwale tubing section 11 and a second gunwale tubing section 12 fixedly attached to a hull 13. In some embodiments, first gunwale tubing section 11 is disposed at least partially around the perimeter of hull 13 and terminates at one side of vessel 10 at distal end 11'. Second gunwale tubing section 12 is substantially shorter in length than section 11, and is disposed at toward the aft of boat 10. Second section 12 includes a proximal end 12' and a distal end 12". Boat 10 also includes a center console 14, a transom 15, and a deck 16 but these features are not to be construed as limiting because other boat and vessel configurations may be equally suitable with regard to the dive door of the present invention.

Figure 4:
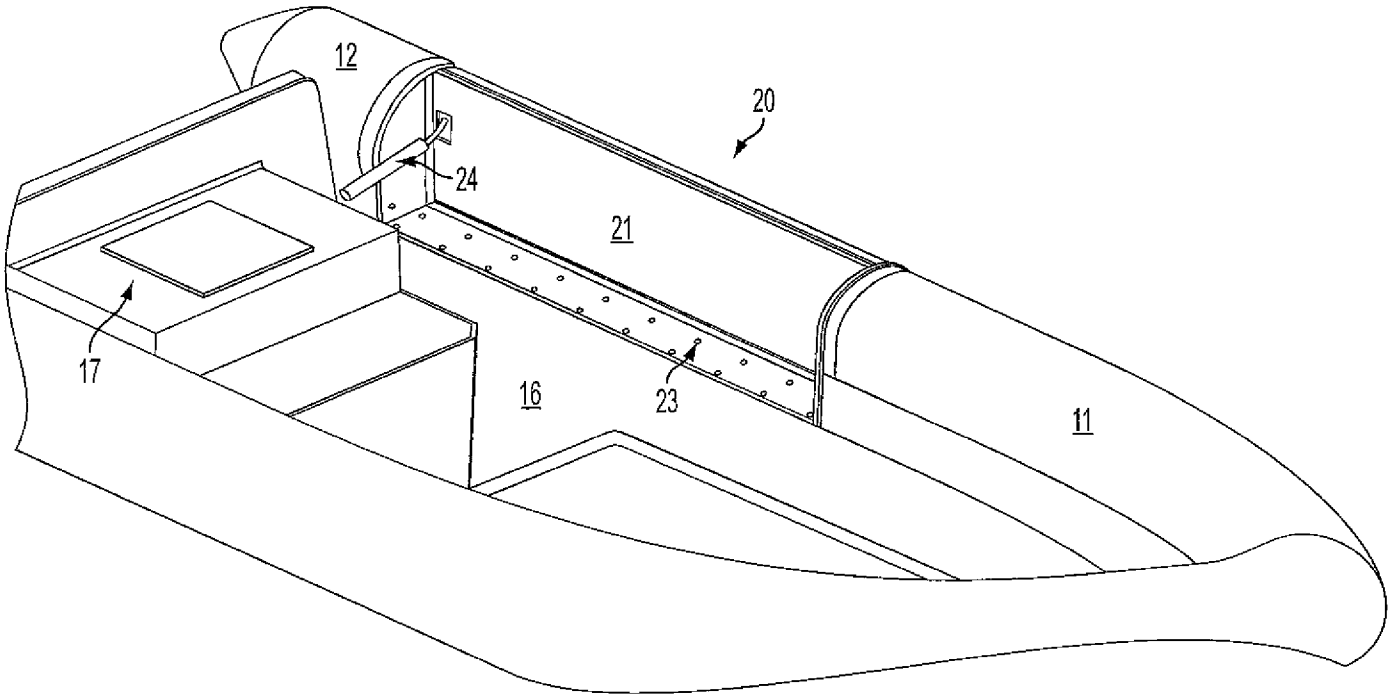
FIG. 4 is another perspective view of a boat including one embodiment of the present invention, in a closed position.
Figure 5:
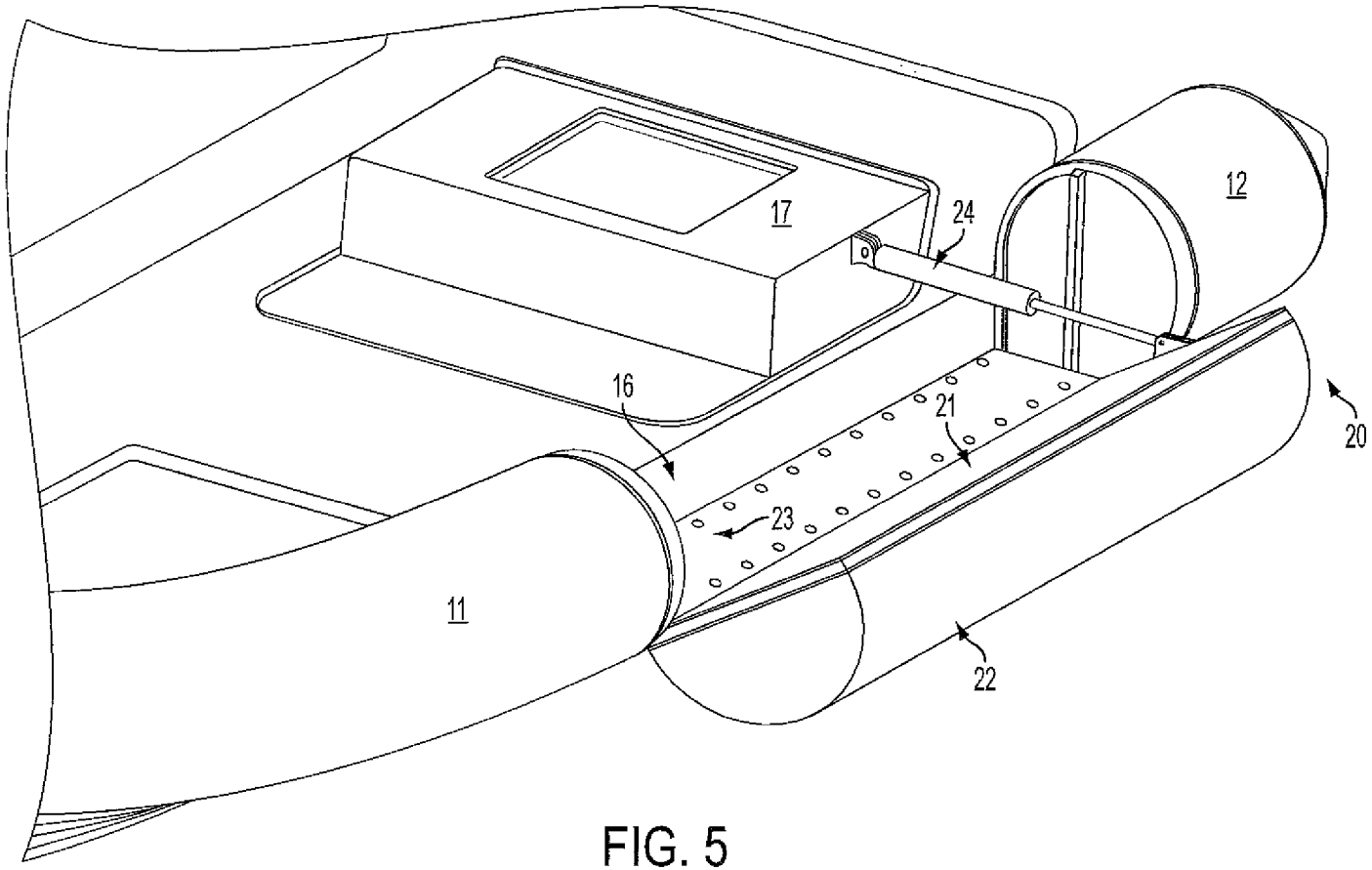
FIG. 5 is a perspective view of a boat including one embodiment of the present invention, in a partially open position.

Disposed between first tubing section 11 and second tubing section 12, and more particularly between distal end 11' and proximal end 12', is dive door 20. Door 20 is generally configured as a semi-cylindrical extended body having a planar platform surface 21 and an outer curved surface 22. Door 20 is hingeably attached to a portion of deck 16 by a hinge 23 which extends along the length of the edge of the planar platform surface 21. Hinge 23 provides a pivot point for door 20, such that door 20 can translate between at least two operative positions. The pivoting action of door 20 is controlled and assisted by ram 24, which may be a hydraulic or electric piston-cylinder mechanism that functions as a linear-force actuator. Ram 24 is attached at a first end to surface 21 of door 20 and at a second end to the structure of boat 20. In the depicted embodiment, ram 24 is attached to rear console 17 of boat 10 and to tongue 25 on surface 21. Tongue 25 provides a pivot point for the end of ram 24. Accordingly, when actuated, ram 24 provides lateral force against surface 21, which when causes door 20 to rotate downward about hinge 23 to allow door 20 to be deployed in an "open" position, as shown in FIG. 1. In the open position, platform surface 21 extends outwardly from the boat, providing an extended and stable working surface. In some embodiments, the platform surface 21 is substantially horizontal and parallel to the deck 16 of boat 10. Ram 24 can also be used to retract door 20, pulling against surface 21 causing door 20 to rotate upward about hinge 23. This allows door 20 to move to a "closed" position, shown in FIGS. 2-4, wherein the platform surface 21 faces the inside of the boat 20, and the outer curved surface 22 is coincident with the first and second gunwale tubing sections 11 and 12. FIG. 5 depicts the dive door 20 in a partially open position and more clearly shows the pivoting action thereof.

Ram 24 is also useful for limiting the range of motion of door 20, while also being capable of locking door 20 in place, which is particularly helpful when door 20 is in its fully "open" position. Accordingly, ram 24 can be used to resist downward movement or displacement of door 20 when forces are applied to surface 21 during use thereof. When door 20 is closed, rain 24 can be used to lock door 20 in place, preventing inadvertent opening thereof. It is appreciated that ram 24 can be electronically activated by the user from on board boat 10 by a switch located, for example, on center console 14 or rear console 17. In other embodiments, latches are provided on either end of door 20, which engage protrusions proximal to distal end 11' and proximal end 12' of tubing sections 11 and 12, respectively. Other means of retaining door 20 in a closed position may be equally suitable, such as straps, buttons, snaps, and the like, however ram 24 would likely provide a more secure hold.

Figure 2:
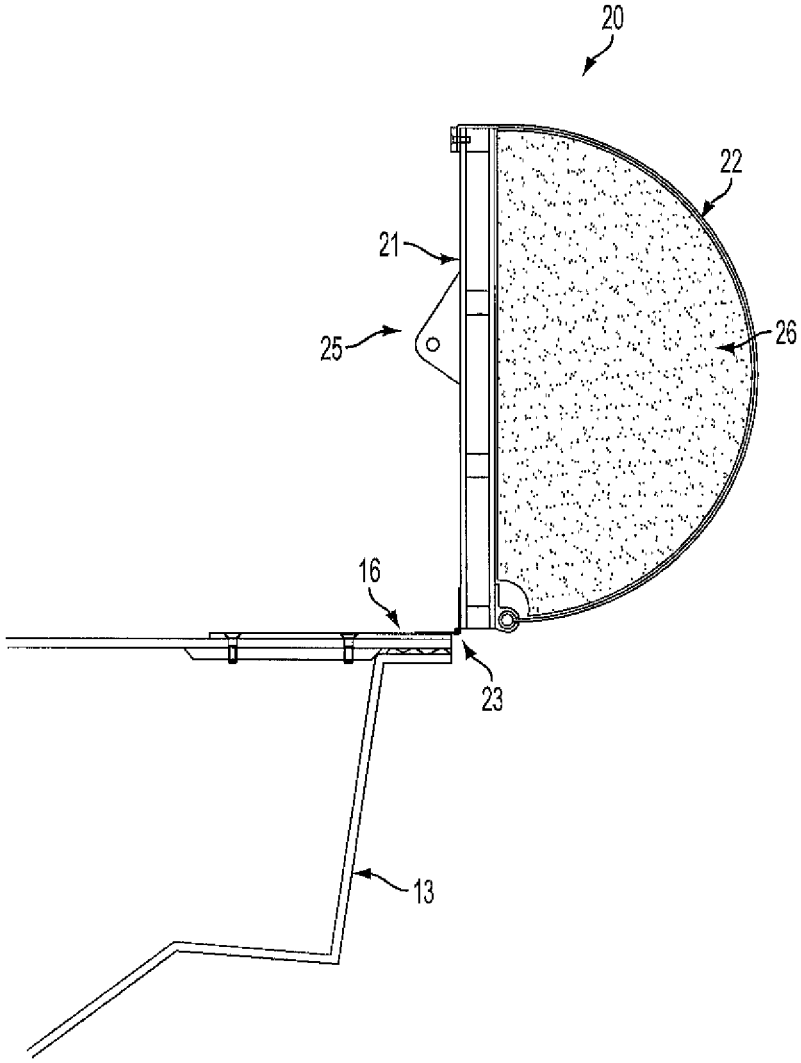
FIG. 2 is a cross-sectional view of one embodiment of the present invention.

FIG. 2 is a cross-sectional view of one embodiment of the present invention. As shown, hinge 23 attaches the bottom edge of platform surface 21 to deck 16. In some embodiments, the hinge is disposed on the gunwale or other surface at the top of hull 13. Disposed between platform surface 21 and curved surface 22 is foam insert 26, which defines the body of door 20. Foam insert 26 provides shock absorption and also increases the overall buoyancy of door 20 such that door 20 provides buoyancy for boat 10 when door 20 is deployed in the open position. In that sense, in the open position, at least a portion of curved surface 22 is in contact with the water, and the relatively buoyant door 20 will float thereon. The shock absorption ability of foam insert 26 is also important, as it will protect boat 20 from damage when coming in contact with other structures, which is one of the general benefits of a rigid-hulled inflatable boat.

Figure 3:
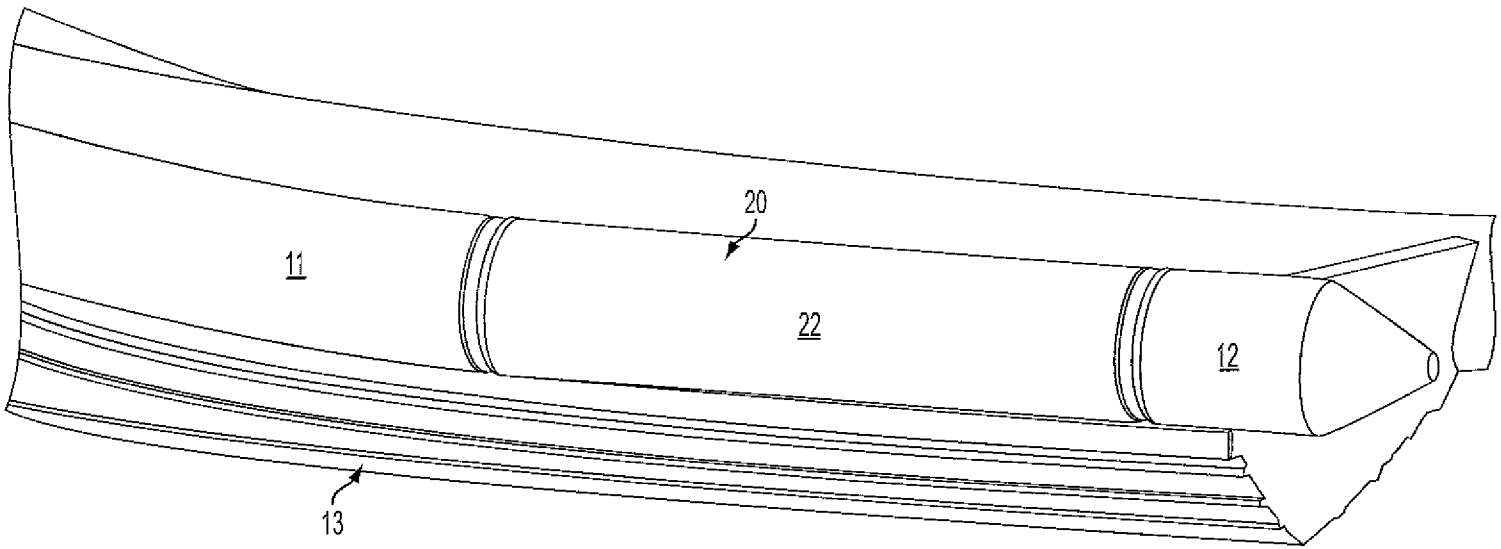
FIG. 3 is a perspective view of a boat including one embodiment of the present invention, in a closed position.

With reference to FIG. 3, in some embodiments, the outer curved surface 22 is configured to have substantially the same dimensions and radius of curvature as the tubing sections 11 and 12. Accordingly, in the closed position, the outer surface 22 of door 20 will be substantially co-incident with the gunwale tubing sections 11 and 12. This configuration makes it appear as though door 20 is integrated with tubing sections 11 and 12 such that the boat 10 has unified gunwale tubing around the entire perimeter of the gunwale.

The present invention provides a substantial improvement of existing dive/access doors for RIBs. Notably, the present invention provides an automatically deployable dive door that provides a wide, flat, and horizontal working surface when in use. The extended working platform surface 21 is desirable because it provides ample space for transferring equipment and individuals, particularly individuals strapped to stretcher or other cumbersome safety/restraint device. Furthermore, the overall design of the present invention is such that the door 20 appears integrated and contiguous with the gunwale tubing of the boat 20 by way of the curved outer surface 22 which is preferably dimensioned to match the size, shape, and configuration of the gunwale tubing sections. This configuration also enhances the seaworthiness of boat 20 as compared to door designs which merely provide a removable section or a gap in the gunwale tubing. Finally, the use of the ram 24 provides for automatic, hands-free deployment and retraction of door 20, which is a substantial improvement over the existing removable or slideable dive door designs, which require a user to manually move and manipulate the door.

It is appreciated that the length, dimensions, and overall size of the dive door and its components can be changed as desired, depending on the specific application. Furthermore, while the foregoing makes reference to the term "dive door," the specific funcationality and/or intended use of present invention is not limited to "diving" application. Rather, the term dive door is to be construed generally as a door providing access to the water from the boat 20 whether for recreational, commercial, or rescue use. Accordingly, the instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dive door for an inflatable boat, comprising:

a semi-cylindrical body having a planar platform surface and an outer curved surface;

said dive door hingeably attached to a deck portion of said boat; and said dive door disposed between a first gunwale tubing section and a second gunwale tubing section of said boat;

wherein said dive door is selectively operable between a deployed position and a closed position, wherein in said deployed position, said planar platform surface extends outwardly from said boat;

wherein in said closed position, said outer curved surface is substantially coincident with said first and second gunwale tubing sections; and a hydraulic ram attached to said drive door configured to move said dive door between at least said deployed position and said closed position.

2. The dive door of claim 1, wherein said hydraulic ram is electronically actuated.

3. The dive door of claim 1, wherein said door is hingeably attached to said deck portion of said boat by a hinge attached along an edge of said platform surface.

4. The dive door of claim 1, wherein a foam insert is disposed between said planar platform surface and said outer curved surface.

5. A boat, comprising:

a rigid hull, a deck, a first gunwale tubing section, a second gunwale tubing section, and a dive door;

said first and second gunwale tubing sections disposed around a top portion of said hull;

said dive door comprising a semi-cylindrical body having a planar platform surface and an outer curved surface;

said dive door hingeably attached to a portion of said deck of said boat; and said dive door disposed between said first gunwale tubing section and said second gunwale tubing section of said boat;

wherein said dive door is selectively operable between a deployed position and a closed position, wherein in said deployed position, said planar platform surface extends outwardly from said boat and wherein in said closed position, said outer curved surface is substantially coincident with said first and second gunwale tubing sections; and a hydraulic ram attached to and disposed between said platform surface and a rigid structure of said boat, wherein said hydraulic ram is configured to move said dive door between at least said deployed position and said closed position.

6. The dive door of claim 5, wherein said hydraulic ram is electronically actuated.

7. The dive door of claim 5, wherein said door is hingeably attached to said deck portion of said boat by a hinge attached along an edge of said platform surface.

8. The dive door of claim 5, wherein a foam insert is disposed between said planar platform surface and said outer curved surface.

* * * * *